United States Patent [19]

Rigterink

[11] 4,212,271

[45] Jul. 15, 1980

[54] RADIAL TORQUE INTERNAL COMBUSTION ENGINE

[76] Inventor: Dale L. Rigterink, 237 Van Raalte Ave., Holland, Mich. 49423

[21] Appl. No.: 911,347

[22] Filed: Jun. 1, 1978

[51] Int. Cl.[2] ..... F02B 53/00

[52] U.S. Cl. ..... 123/43 B; 123/245

[58] Field of Search ..... 123/43 B, 245; 418/33, 418/34

[56] References Cited

U.S. PATENT DOCUMENTS

| | | | |
|---|---|---|---|
| 1,298,610 | 3/1919 | Werle | 123/43 B |
| 1,547,991 | 7/1925 | Wood et al. | 123/43 B |
| 1,645,471 | 10/1927 | Armitage | 123/43 B X |
| 1,823,132 | 9/1931 | Cunningham | 123/43 B |
| 1,940,049 | 12/1933 | Dap | 123/43 B |
| 2,280,967 | 4/1942 | Nelson | 123/43 B |
| 2,353,065 | 7/1944 | Petrilli | 123/43 B |
| 3,288,122 | 11/1966 | Atsalos et al. | 418/34 X |
| 3,938,480 | 2/1976 | Yanda | 123/43 B |

FOREIGN PATENT DOCUMENTS

| | | | |
|---|---|---|---|
| 885953 | 1/1962 | United Kingdom | 123/43 B |

*Primary Examiner*—Michael Koczo

*Attorney, Agent, or Firm*—Price, Heneveld, Huizenga & Cooper

[57] ABSTRACT

In a rotary internal combustion engine the cylinders forming the combustion chambers are circumferentially arranged in a rotatably mounted engine housing. The housing is fixed to the engine shaft which in turn is journalled for rotation in a supporting framework. A brake mechanism is provided for holding the pistons with respect to the supporting framework during a power stroke preventing retrograde movement of the pistons to thereby urge the housing and shaft to rotate. Upon cessation of the power stroke, the brake is released, the pistons rotate with the housing and a bias spring assembly is provided to urge the pistons into the cylinder in a compression stroke. The engine thus is continuously rotated to deliver power output at the shaft.

6 Claims, 23 Drawing Figures

RADIAL TORQUE INTERNAL COMBUSTION ENGINE

BACKGROUND OF THE INVENTION

A typical internal combustion engine of the reciprocating piston type includes a combustion space in which a piston is movable. The compression of a fuel mixture in the cylinder by the piston, when ignited, increases the pressure within the cylinder and drives the piston and the cylinder heads apart. At the end of the power stroke, an exhaust port opens releasing the burned gases. A new fuel mixture is compressed and the cycle repeats itself.

Various attempts have been made in the past to provide a rotary internal combustion engine wherein the pistons do not reverse direction as in a reciprocating piston engine but rather move relative to the cylinders which rotate with the cylinder housing through an arcuate path. Representative prior art patents illustrating such devices are shown, for example, in U.S. Pat. Nos. 1,547,991 issued July 28, 1925 to A. F. Wood et al. entitled ROTARY GAS ENGINE; 1,940,049 issued Dec. 19, 1933 J. Dap entitled MACHINE HAVING PISTONS AND CYLINDERS ARRANGED AROUND A CIRCUMFERENCE; 2,328,799 issued Sept. 7, 1943 to J. A. Gaylord entitled ROTARY PISTON MECHANISM; and 2,353,065 issued Sept. 7, 1943 to J. A. Gaylord entitled ROTARY PISTON MECHANISM. In each of the above mentioned and other prior art patents, the cylinder is disposed circumferentially with respect to the crank shaft or equivalent component and moves in a rotary manner with respect thereto. The basic drawback of the prior art devices resides in the complex mechanisms involved for holding or locking the piston in position to prevent retrograde movement during the power stroke and to shift the piston within the cylinder in the opposite direction during the corresponding compression stroke. The mechanisms for holding and returning the piston during the various strokes have typically involved gear mechanisms, cam and cam follower mechanisms, wobble plates and the like to cause movement of the pistons while maintaining a continuous rotation of the cylinder and housing. Such prior art devices have not won widespread commercial acceptance as they were extremely large, complicated and subject to failure with breakage or wear of the mechanical meshing components.

The present invention overcomes the difficulties encountered in such prior art devices in its provision of braking means for holding the piston from retrograde movement during the power stroke and additionally in the provision of biasing means for urging the piston into the cylinder during the compression stroke. In the present invention, the involved and complex meshing gear components have been eliminated, thus, significantly simplifying the structure.

SUMMARY OF THE INVENTION

The present invention provides an improved rotary internal combustion engine wherein a shaft forming an axis of rotation includes, as an integral part therewith, a surrounding rotatable cylinder housing fixed to the shaft having arcuate toroidal-shaped cylinders or combustion chambers formed therein concentric to the shaft. The shaft and housing are rotatably journaled in a supporting framework. Pistons are positioned to coact in the cylinders to provide alternating power and compression strokes as in a two-cycle operation. The invention includes means for fixing the pistons with respect to the supporting framework during the power stroke to prevent retrograde movement. The piston is fixed upon the initiation of ignition, i.e. the power stroke, and the housing and supportive shaft are urged to rotate with respect to the framework. The means for fixing the piston with respect to the framework is adapted to release the piston with respect to the framework after the power stroke whereby the pistons will rotate with the housing. Additionally, means is provided for urging the pistons, during rotation, in the same direction of rotation to advance the pistons into the cylinders to provide a compression stroke.

More specifically, the improved rotary internal combustion engine of the present invention includes a piston that reciprocates within the cylinder at a constant radius in a plane perpendicular to a central axis. The cylinders are held in a relatively fixed position with respect to a central axis or shaft in a housing. The pistons are each fixed to a piston rod and supported by a torque arm freely movable around the shaft on a torque sleeve. The sleeve forms a continuous concentric ring about the shaft and extends to the outside of the engine housing where it is fixed to a brake mechanism that limits the motion of the piston when combustion occurs. In operation, during combustion, the brake momentarily holds the pistons stationary while the cylinder heads and housing are forced apart from the piston. The cylinder head, engine housing and the shaft are then in rotary motion.

After the power stroke when the piston and cylinder head are at maximum distance apart, the brake is released allowing the movable part of the brake and the pistons to rotate at the same angular velocity as the engine housing and shaft. When the pistons, cylinders, shaft and housings are rotating at the same angular velocity and in the same direction, the pistons are returned toward the cylinder head in a compression stroke by a coil spring that moves the pistons at an angular velocity greater than the engine housing and shaft.

In a preferred embodiment of the invention, the brake assembly for the piston includes a rotatable disc portion and a pair of brake pads or shoes. The disc portion is mounted for rotation with the pistons and shaft while the shoe portions are fixed relative to the supporting framework. The coil spring that returns the piston during a compression stroke is also adjustable to vary the return distance of the piston within the cylinder to thus vary the power and time required for the piston to complete a compression stroke and thus influences the compression ratio of the fuel-air mixture within the combustion chamber.

Since the piston is not mechanically connected to the rotatable shaft and its associated housing, suitable electronic controls are provided to initiate ignition within the cylinder. Accordingly, the piston can begin a power stroke at virtually any position relative to the cylinder head. The compression ratio of the air-fuel mixture is controlled by the distance the piston moves into the cylinder before ignition occurs. Timing mechanisms are provided to initiate ignition at the proper time depending upon speed, compression, load and the like. For example, the compression ratio can be increased by delaying the spark plug firing since the piston does not have to reach a top dead center position and reverse direction as in conventional internal combustion engine. The ignition and firing position is determined by timing mechanisms and the like hereinafter described. A power stroke controller allows the compression ratio to be varied so that the engine always operates at maximum efficiency. When the engine is idling under no load condition, for example, the compression ratio is extremely low, while under load the compression ratio is increased.

The construction, operation and the many features and advantages of the present invention will become readily apparent to those skilled in the art upon reading the following specification with reference to the accompanying drawings.

DESCRIPTION OF A PREFERRED EMBODIMENT OF THE INVENTION

Figure 1:
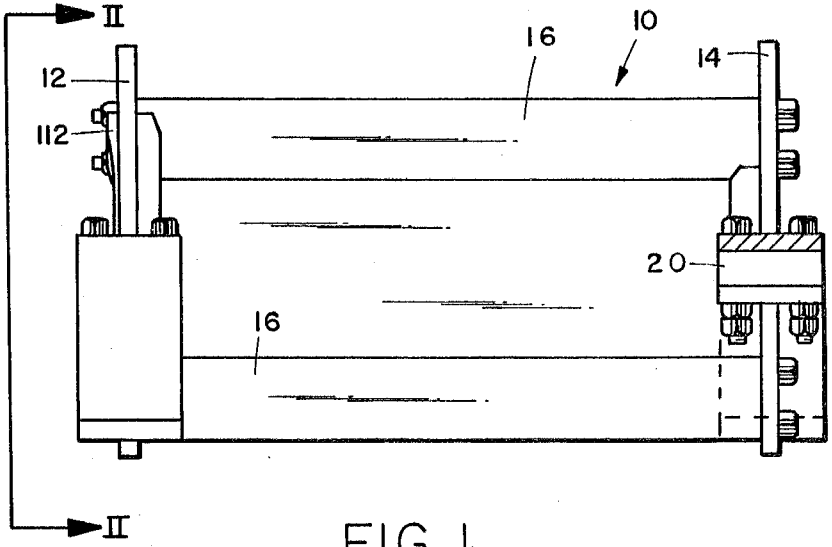
FIG. 1 is a side view of a representative engine mounting support structure.
Figure 2:
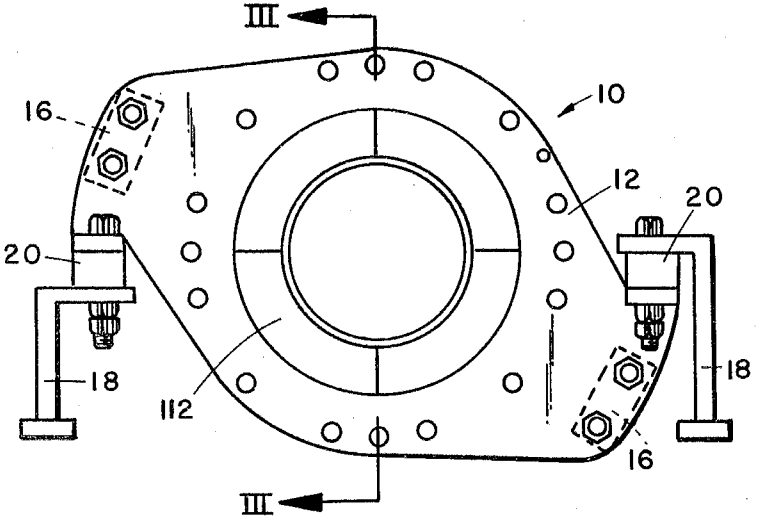
FIG. 2 is an end view of the supporting structure shown in FIG. 1 as viewed along the line II—II.

Referring now to the drawings and in particular to FIGS. 1, 2, 3 and 4, the rotary internal combustion engine of the present invention is supported for operation in an engine support structure generally designated by the numeral 10. The engine support includes a front or left-hand support plate 12 and a rear or right hand support plate 14. At least a pair of spacers 16 (FIGS. 5*e* and 5*m*) are fixed to extend between the front and rear support plates to control the spacing therebetween. Engine mounting braces 18 are provided to fix the engine assembly to the structure in which it is ultimately utilized. Preferably, vibration isolators 20 formed of hard rubber or similar material are secured between the engine mounting braces 18 and the associated front and rear support plates 12 and 14. Alternately, the engine may be enclosed between supports 12 and 14 in a cylinder-like housing with appropriate openings for the carburetor, electrical leads, exhaust pipe, engine cooling air, and engine adjustment access.

Rear support plate 14 has an opening 22 formed through the central portion thereof (FIG. 5*m*) surrounded by a flange-like portion 24. The flange forms a housing to receive a tapered roller thrust bearing 26 in which one end of the engine shaft or axle 28 (see also FIGS. 3 and 8) is rotatably supported. The opposite end of shaft 28 extends through front support plate 12 where it is mounted with other component parts for rotation with respect to the support structure on a second tapered roller thrust bearing 30. The front or output end of shaft 28 extends outwardly where a pulley 32 or other suitable power take-off mechanism is fixed. Pulley 32 is used to operate the engine accessories. Pulley 32 may be fixed to the axle by means of conventional structures as a key 34 and set screw 36. The opposite end of shaft 28 is splined as indicated at 306 (FIGS. 3, 5*l* and 8) for connection to a transmission (not shown) or similar mechanism to utilize the engine power output.

The engine embodiment illustrated includes two cylinder structures each of which includes a piston and a connecting rod connected to a common torque sleeve. Similar components are, therefore, designated with similar reference numerals. The front or number one piston as viewed in FIGS. 3 and 5*a*–5*m* has the basic reference designation, i.e. 40, for the left piston, while those on the right having similar characteristics bear the same reference numeral with the suffix "a". It will also be understood that the present invention can utilize one, two or more cylinders depending upon the desired output characteristics of the engine. For simplicity and clarity, however, the two-cylinder model of the present invention is disclosed and illustrated in detail.

With additional reference to FIGS. 5*a*–5*m*, the internal combustion engine of the present invention basically includes a plurality of combustion chambers or cylinders 38, 38*a* formed circumferentially with respect to shaft 28. Shaft 28 forms the axis of rotation for the engine within the supporting structure 10. Pistons 40, 40*a* are cooperably operable in cylinders 38 and 38*a* to cause the cylinders and the associated engine housing to rotate about the axis of shaft 28. The cylinders and associated rotatable mechanisms to be hereinafter described including shaft 28 are mounted for rotation with respect to front support plate 12 and rear support plate 14.

Each piston is supported for movement in its respective cylinder with respect to the housing by support means including connecting rods 42, 42*a* attached at one end to the piston 40, 40*a* and at the opposite end to torque sleeve 44. Torque sleeve 44 is rotatable about shaft 28. The torque sleeve 44 is preferably formed as two parts 44 and 44*a* each fitting over either the left or right end of shaft 28. The two parts, shown as partial circles in FIG. 5*h* when assembled together by bolts or welding, butt against flanges 186 and 224 (FIG. 3) to form a complete circle. The cylinders 38, 38*a* are retained in a housing portion generally designated by the reference numerals 48 and 48*a* (see FIGS. 5*h* and 5*i*). The piston is movable toward and away from the top of the cylinder with rotation of the housing between power and compression strokes. Cylinder housings 48 and 48*a* also contain fuel inlet and fuel exhaust passageways, to be discussed hereinafter, which are in communication with the combustion chambers, that is, the area formed in the cylinder above the top of the piston.

A brake assembly generally designated by the numeral 50 includes a disc brake 52 and a pair of shoes 54 and 56 operable to hold the pistons 40 and 40*a* with respect to the rotating structure during a power stroke to prevent retrograde movement of the pistons upon ignition to urge the cylinder housing structure to rotate about the axis of shaft 28.

To return the pistons toward the top of the cylinders in a compression stroke, biasing means in the form of a pair of springs 58 and 60 are operatively connected to the housing and the pistons. Springs 58 and 60 bias the pistons in the same direction of movement as the cylinder housing to move the pistons into the cylinders while the cylinder structure and shaft are rotating with respect to the supportive framework.

Each cylinder 38 is equipped with a spark plug 62 to ignite the fuel mixture when a predetermined position of the pistons is reached during the compression stroke to thereby initiate a power stroke. Sensing means is provided to sense the position of the pistons with respect to the cylinder head and to release brake assembly 50 allowing the pistons to rotate with the housing during the compression stroke as springs 58 and 60 urge the pistons into the cylinders. Movement of the pistons is alternately retarded and accelerated relative to the movement of the cylinder housing. Since the cylinder structures 38 and 38*a* are fixed and rotate with the housing and axle, and angular movement of rotation of the housing with each power stroke transmits power to output spline 306, right side of shaft 28, and to output pulley 32 fixed at the left end of shaft 28. As mentioned previously, the output pulley may be connected in any conventional manner to drive accessories while the opposite end at spline 306 may be directly coupled to suitable transmission means.

Figure 5A:
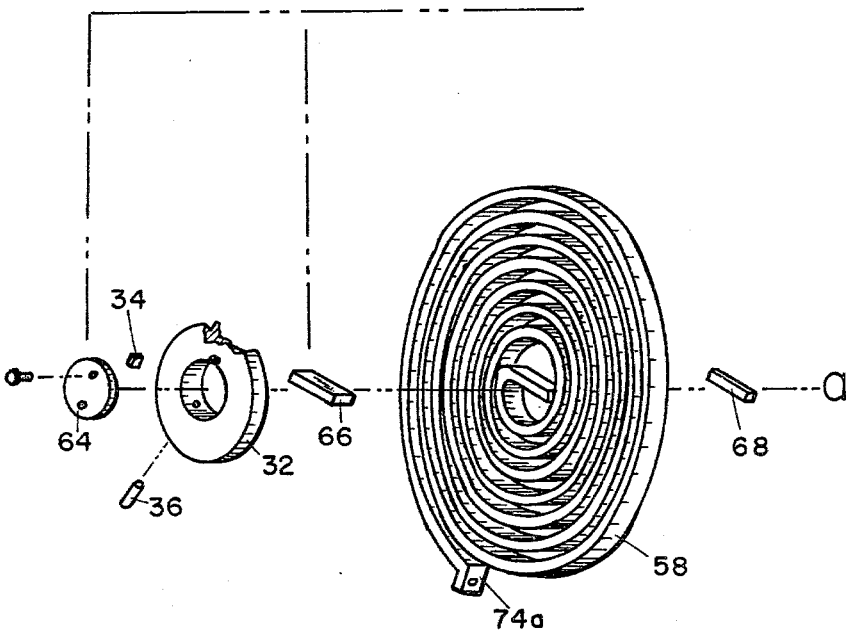
FIGS. 5*a*–5*m* are a series of views showing in exploded form the engine shown in FIGS. 1–4.
Figure 5B:
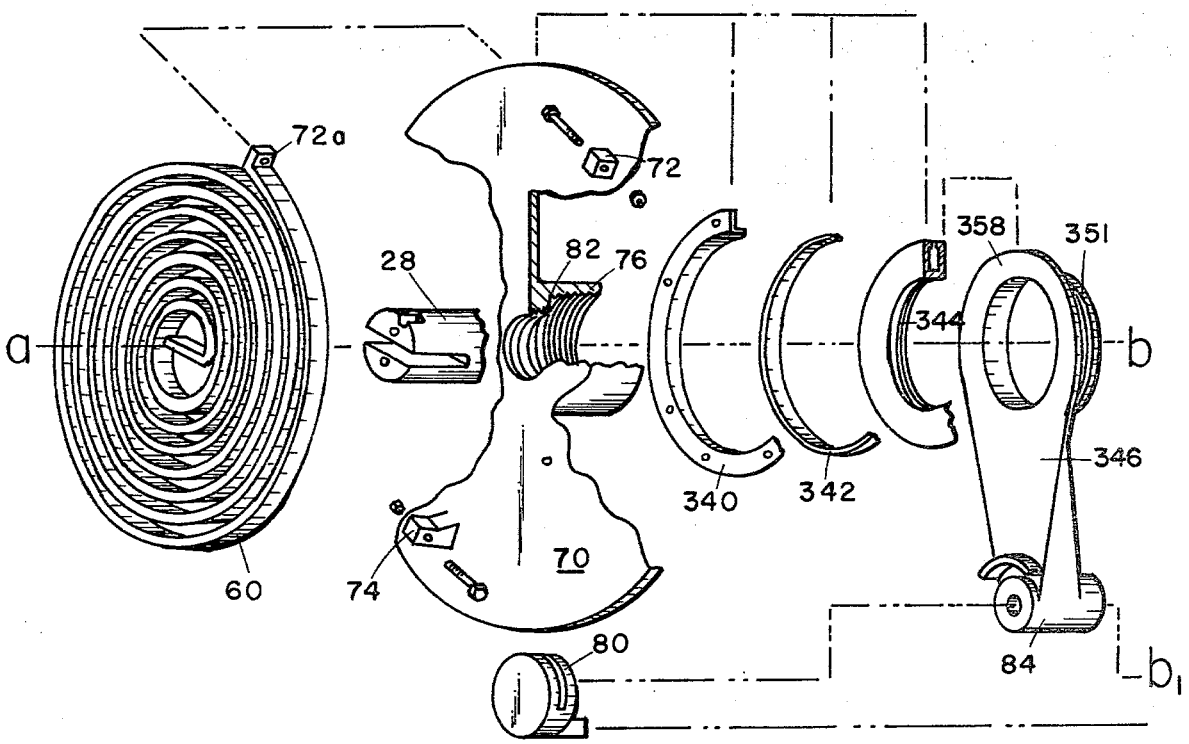
Figure 5C:
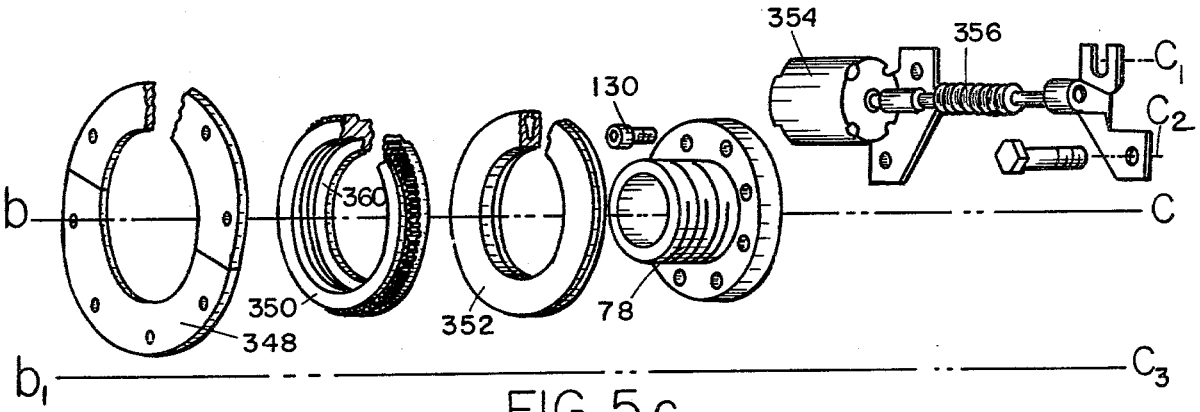

Referring to FIGS. 5*a*–5*m*, each of the operative components of the invention will be described briefly to thus illustrate the engine construction and to explain the operation thereof. In FIG. 5*a*, for example, beginning at the left or output end of the engine, a small circular end cap 64 is held in place in a conventional manner to the end of shaft 28 and serves to retain key 34 in pulley 32 and also to hold a spring holder 66 against bias spring 58. A spring spacer 68 maintains the correct spacing between bias spring 58 and bias spring 60. Springs 58 and 60, as previously mentioned, are provided to force the pistons 40 into the cylinders 38 in a compression stroke. As will be described hereinafter, the spring tension is adjustable to vary the compression ratio of the engine and vary the angular velocity of the pistons during a compression stroke.

Reference numeral 70 illustrates a spring disc having a pair of upstanding projections 72 and 74 to which the outer ends 72*a* and 74*a* of springs 58 and 60 are secured, respectively, by conventional fastening means as illustrated. The spring disc reciprocates in a circular motion with movement of the pistons and is movable to the left and right along the axis of shaft 28. Spring tension is maximum when the disc is moved outwardly or to the left and minimum when it is moved inwardly or to the right. Spring disc 70 has a threaded hub portion 76 adapted to threadably receive a mating hub 78 fixed to disc brake 52. The cooperation between spring disc hub 76 and brake hub 78 serves to connect springs 58 and 60 to the spring disc 70 and to the disc brake 52.

A spring tension adjuster assembly 80 is positioned to engage and hold spring disc 70 to allow the springs to be wound and increase the spring compression when the engine is started as will be explained hereinafter.

Figure 10:
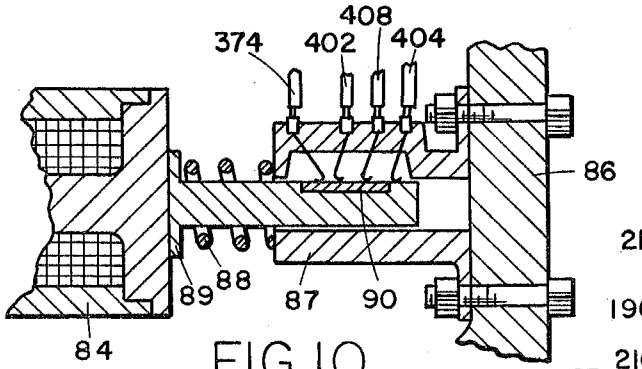
FIG. 10 is an enlarged fragmentary view of the electromagnet and holder assembly shown in FIG. 3.
Figure 3:
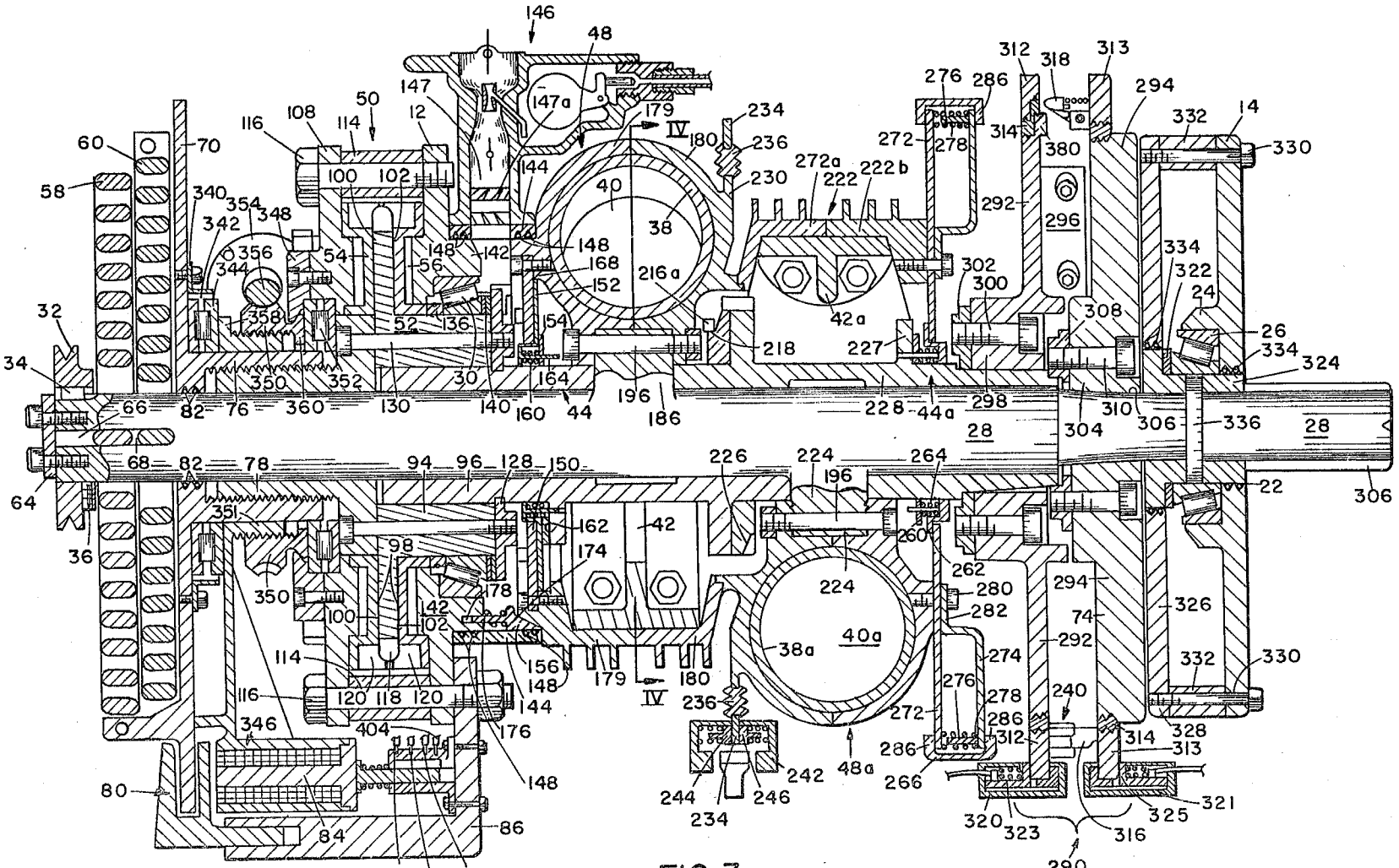
FIG. 3 is a cross-sectional view of the engine as viewed generally along the plane III—III of FIG. 2.

A pair of sealing rings 82 are positioned on the inner opening of the spring disc housing surrounding shaft 28 to prevent leakage of the fuel-air mixture along the shaft. The spring tension adjustment assembly 80 associated with spring disc 70 is operated by an electromagnet assembly 84 which is retained in a holder assembly 86. Electromagnet assembly 84 shown in greater detail in FIG. 10 includes holder assembly 86 which in turn is secured to support 12 (FIG. 3). Holder assembly 86 has a movable portion 80 to engage and prevent the spring disc 70 from turning. The holder assembly also cradles the electromagnet 84 and coil spring tension adjustment mechanism 346 so that it does not rotate. It also holds a nonconductive electrical housing 87 in which a number of switching elements are contained as will be hereinafter described.

A spiral spring 88 is provided to keep a spring disc position indicator 89 against the electromagnet holder and spring tension adjustment device. An electrical conductor plate 90 is set in spring disc position indicator 89 to conduct current as will be hereinafter explained to the maximum, minimum and starting position switches.

Disc brake assembly 50 holds the pistons 40 and 40*a* and the associated torque sleeve during a power stroke of the engine thereby forcing cylinders 38 and 38*a* and the axle 28 to which they are connected to rotate. Disc brake 52 is positioned between brake shoes 54 and 56. The disc brake is provided with a splined central portion 94 to receive a corresponding spline 96 on torque sleeve 44.

The left hand brake shoe 54 and right hand brake shoe 56 are basically identical, each having a face surface 98 adapted to frictionally engage corresponding surfaces 100 and 102 (FIG. 3) formed on disc brake 52.

Figure 5D:
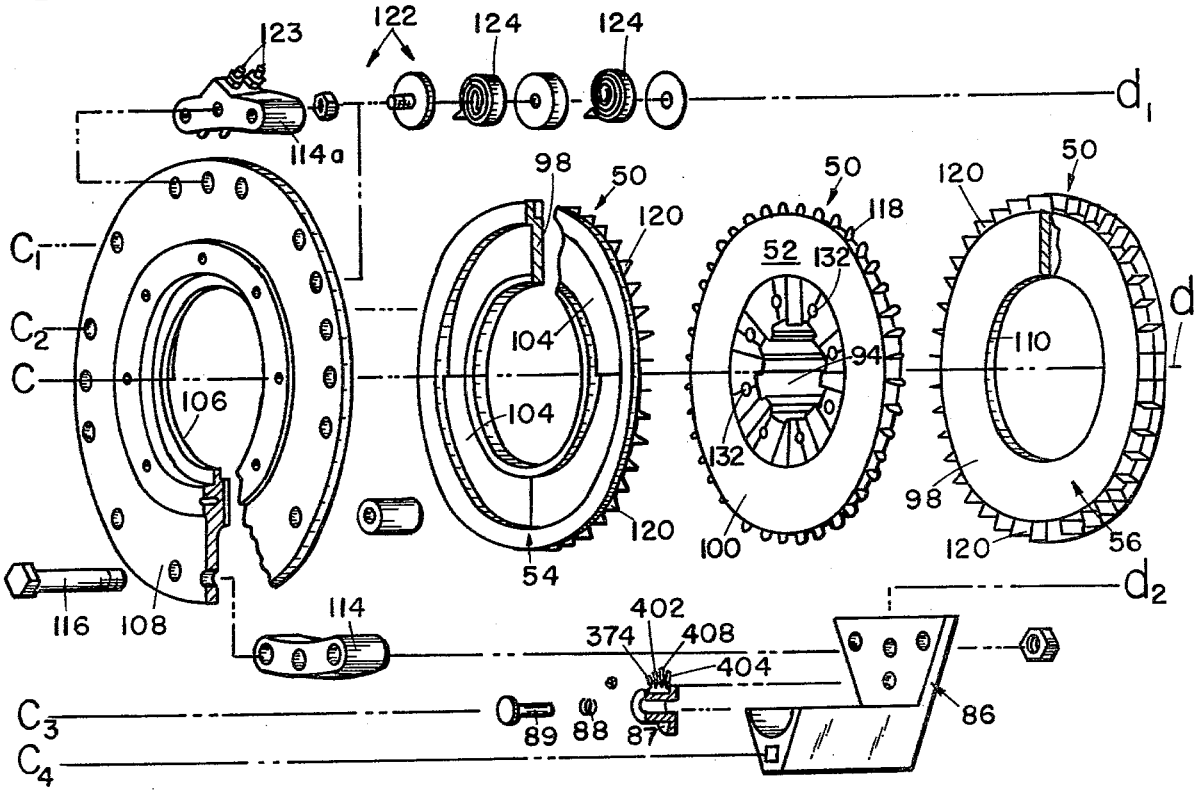

The side opposite the facing surfaces on each brake shoe 54 and 56 has a circular inclined plane or ramp surface machined thereon. Brake shoe 54 as shown in FIG. 5*d* has a ramp surface 104 formed thereon adapted to engage with a corresponding ramp surface 106 formed on the brake support structure 108. Brake shoe 56 is similarly equipped with a circular inclined plane or ramp surface 110 (FIG. 5*d*) adapted to engage with a corresponding ramp surface 112 (FIGS. 1, 2 and 5*e*) machined on the side of front support plate 12.

Brake support 108 and front support plate 12 are fixed to each other and spaced apart by spacers 114 and 114*a*. Screws 116 or other suitable fastening means secure brake support 108 to front engine support 12 to cooperatively form the brake assembly 50. The disc brake 52 is designed to be as friction-free as possible when the brake is rotating with rotation of the engine. Air fins 118 around the outside diameter of disc brake 52 force air into corresponding air fins 120 formed around the outer diameter of brake shoes 54 and 56. In addition to the cooling function, the air fins tend to push the shoes away from the disc brake during engine rotation.

One of the spacers, 114*a*, positioned between brake support 108 and front support plate 12 also carries suitable brake shoe adjustment mechanisms 122 including a pair of springs 124. Adjustment mechanism 122 includes a pair of screws 123 threaded into support spacer 114*a* to prevent brake shoes 54 and 56 from being pushed too far away from disc brake 52 by the force of air from the rotating disc brake against the brake shoes. The end of the screw rests against one of the air vanes 120 on the brake shoe. Springs 124 are wound, when installed, to push the brake shoes 54 and 56 in the direction opposite engine rotation. Upon ignition, when the pistons attempt to reverse direction, springs 124 urge brake shoes 54 and 56 against disc brake 52 to insure surface contact. Once shoes 54 and 56 establish a contact with disc brake 52 and slight rotation of the sleeve 44 occurs, there is caused a wedging action and self-tightening effect on the circular inclined ramps 104, 106 and 110 and 112 to urge the facing friction surfaces 98, 100 and 102 of the shoes and brake into tight engagement. When the brake is thus engaged, the pistons are held against movement and while ignition occurs, the cylinder assembly rotates with the engine structure.

Figure 5E:
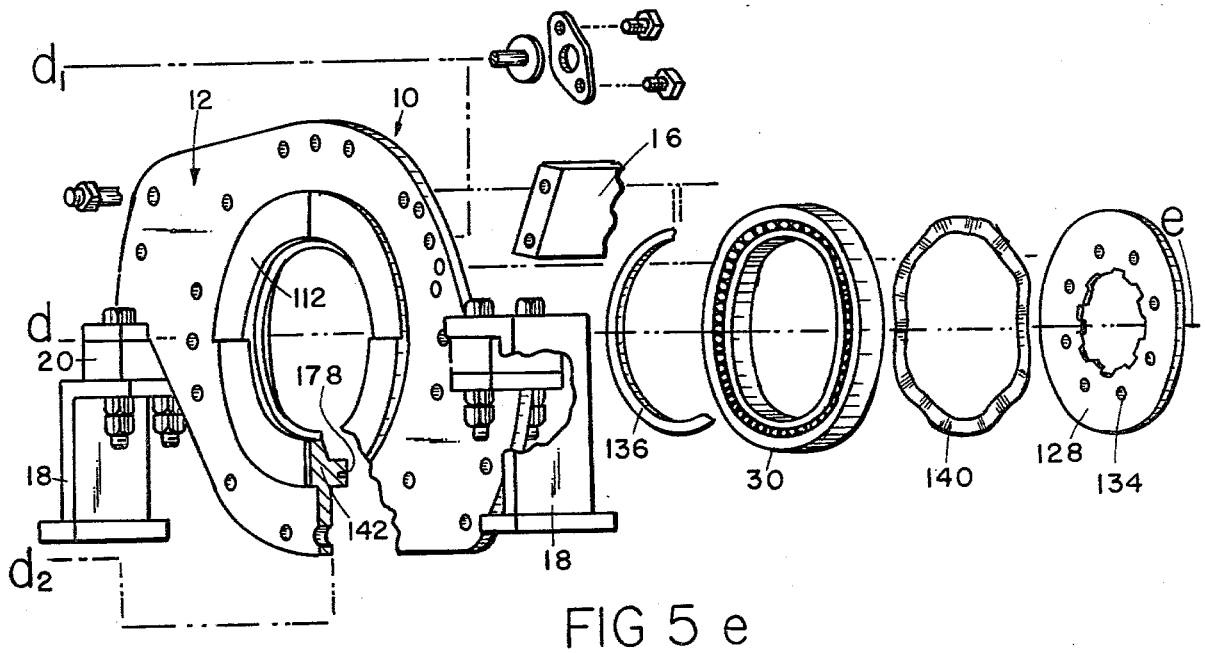

The spline portion 96 of left torque sleeve 44 (FIG. 5*f*) engages the corresponding spline 94 formed in the center of disc brake 52. Torque sleeve 44 is fixed to the disc brake by a spline holder 128 and screws 130 (FIGS. 5*c* and 5*e*). Screws 130 extend through the openings in the flange of hub 78, through openings 132 in the disc brake, and are received in tapped openings 134 formed in spline holder 128. Screws 130 and spline holder 128 also position a seal 136 which prevents escape of the fuel air mixture, tapered roller thrust bearing 30 which supports the engine for rotation in front support plate 12, and a wave washer 140. Wave washer 140 keeps a constant force on thrust bearing 30 to retain its position in the front support plate. Bearing 30 is supported in the machined inner diameter of a flange 142 formed on the inner facing surface of front support plate 12. The outer diameter of flange 142 is also machined to provide an annular surface upon which is mounted a carburetor holding ring 144.

Carburetor holding ring 144 is fixed relative to engine rotation and supports a carburetor 146. The carburetor is of conventional construction and accordingly will not be described in greater detail. An air fuel mixing chamber 147 is located at the base of carburetor 146 and helps to mix the fuel with the air just before it enters the interior of the engine. The mixer has a plurality of small wedge-shaped knives 147*a* (FIGS. 3 and 5*f*) that cut the mixture and compress it with the wedge shape. When the mixture leaves one layer, it expands, is cut by the sharp edge of the wedge and is shifted 90° in direction. The 90° turns help to prevent fuel streaks and the compression-expansion action is to help mix the fuel with the air. The mixing chamber is designed to mix the air and fuel with a minimum of resistance to the mixture flow. Suitable sealing elements 148 are positioned around flange 142 and the inner diameter of carburetor holding ring 144 to prevent leakage of the fuel air mixture.

Carburetor holding ring 144 is associated with a first fuel valve disc 150 fixed to the engine housing, a second fuel valve disc 152 fixed to the torque sleeve, a holding disc 154, a self-tightening seal ring 156 and a plurality of bias springs 158 (positioned between support 12 or flange 142 and seal ring 156) and springs 160. These elements cooperatively form the fuel air mixing chamber and the fuel inlet manifold for the engine.

Figure 5F:
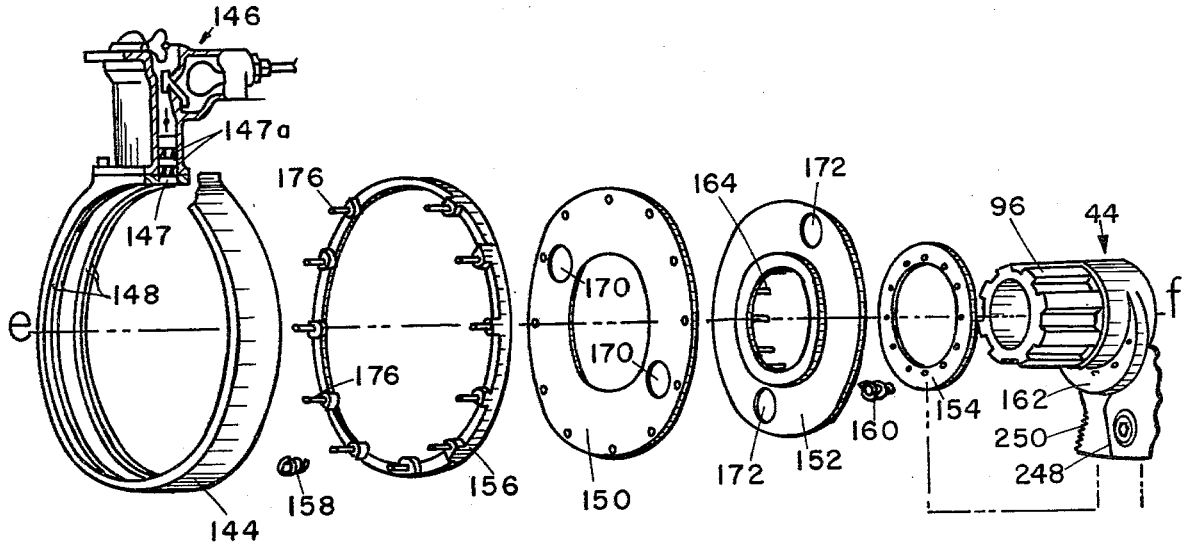
Figure 5G:
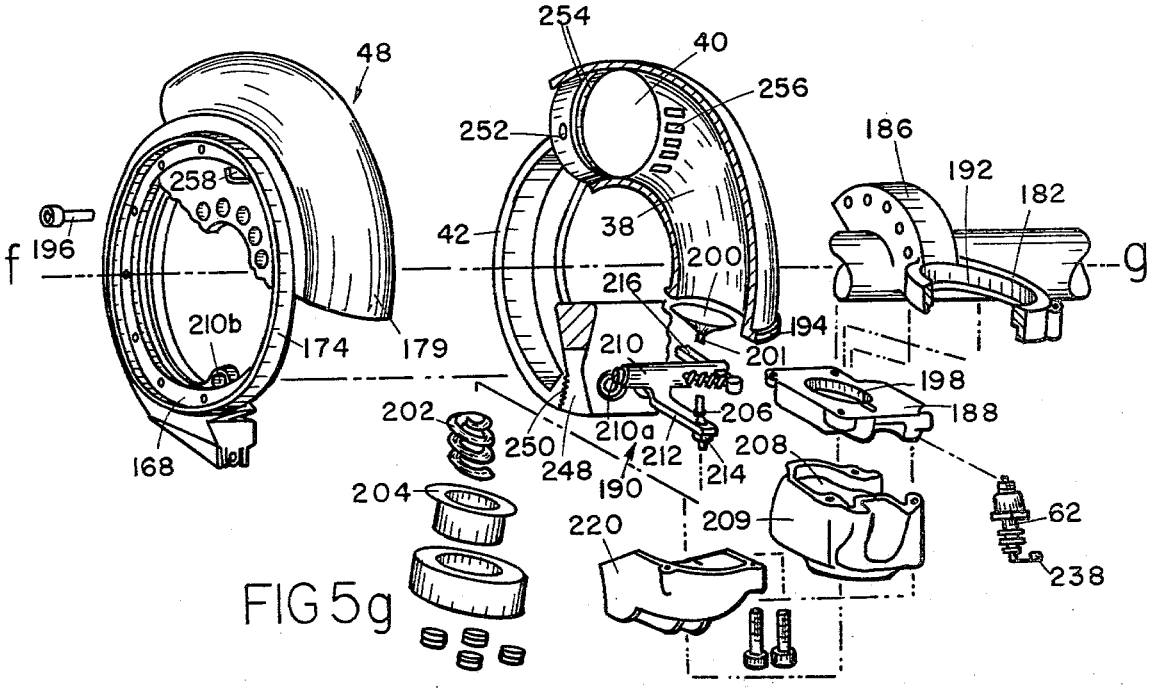
Figure 5H:
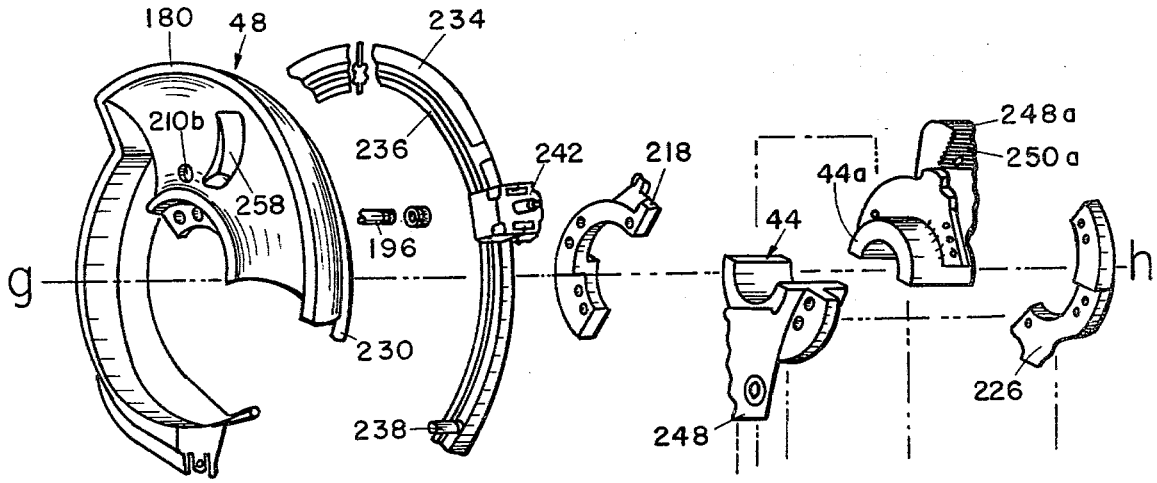
Figure 5I:
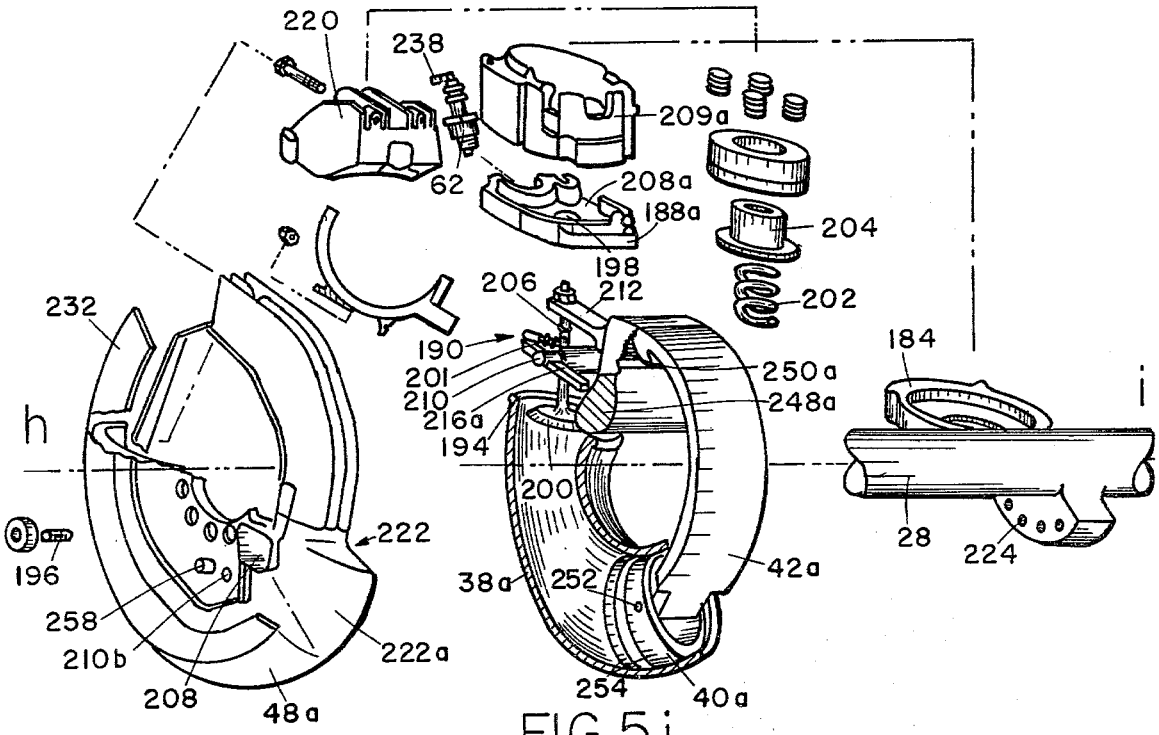
Figure 5J:
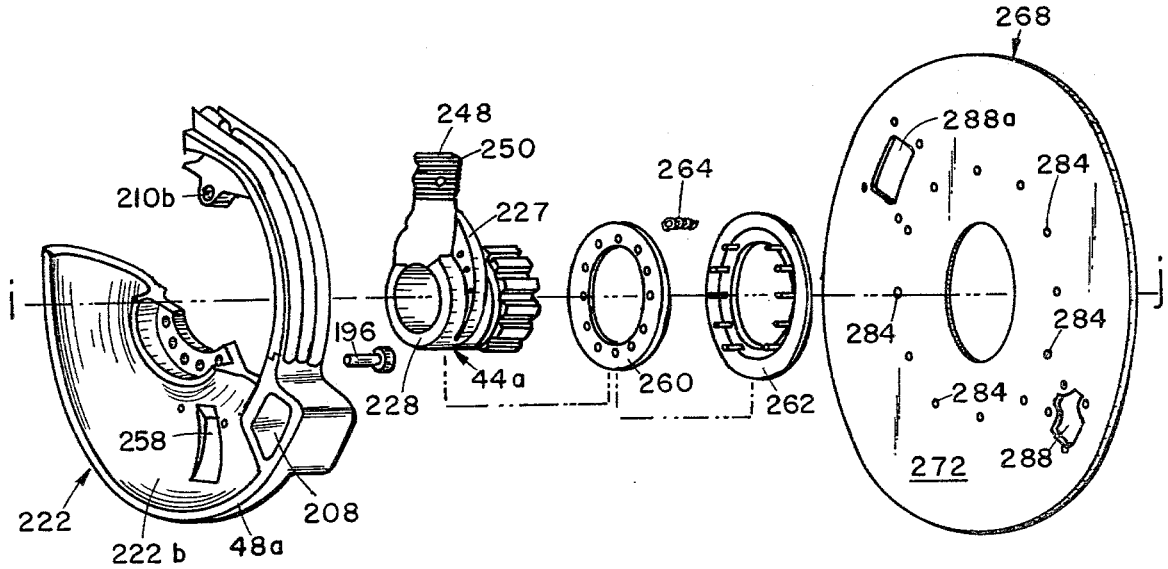

As shown in FIGS. 3 and 5*f*, holding disc 154 abuts a radial surface 162 formed on torque sleeve 44 and is held with respect thereto by a plurality of pin members 164 extending outwardly from the central portion of the second or torque sleeve fuel valve disc 152. A plurality of springs 160 are positioned over pins 164 and abut holding disc 154. Springs 160 bias fuel valve disc 152 against the first fuel valve disc 150 fixed to the housing. Fuel valve discs 150 and 152 cooperatively operate to seal the air-fuel mixture during a power stroke of the engine.

First fuel valve disc 150 is fixed to a side portion 168 of cylinder housing 48. Disc 150 has two openings 170 formed therethrough positioned 180° apart. Second or torque sleeve fuel valve disc 152 is fixed to the torque sleeve by pins 164 passing into openings formed in a radial surface 162 on the torque sleeve. Springs 160 bias disc 152 against disc 150. Disc 152 is similarly provided with two openings 172 positioned 180° apart that are in alignment with openings 170 in disc 150 when the pistons are near the end of a compression stroke. When openings 170 and 172 in disc 150 and 152 are in alignment, the air-fuel mixture is forced into the engine housing below the pistons by the partial vacuum created by piston movement. The surface between discs 150 and 152 is lubricated by the air-fuel mixture.

An annular sealing flange 174 formed adjacent side portion 168 of engine housing 48 is adapted to seal against the inner diameter of self-tightening seal ring 156. Seal ring 156 has a plurality of outwardly extending pins 176 formed thereon which are received in corresponding pin-receiving openings 178 (FIG. 3) formed in the inner facing surface of flange 142 on front support plate 12. Springs 158 are positioned over pins 176 between flange 142 and seal ring 156 to bias the seal ring into sealing engagement with sealing flange 174 on the engine housing. Pins 176 also prevent the seal ring from rotating and fix the seal ring with respect to the front support plate 12.

With reference to FIGS. 3, 4 and 5*g*–5*j*, the piston, cylinder and the cylinder housing will be described in somewhat greater detail. As mentioned earlier, each piston 40 is mounted for movement in a cylinder 38. Cylinder 38 is formed as an arcuate sleeve positioned and held in the cylinder housing 48. The number one, or front cylinder housing, includes two portions, the first or left side housing portion 179 having the previously mentioned side portion 168 and flange 174 formed thereon to seal against the self-tightening seal ring 156 and a second or right side housing portion 180. The housing portions 179 and 180 are generally arcuate in configuration and are adapted to be fixed together to engage and hold the cylinder 38 forming cooperatively the cylinder housing 48. The housing portions are fixed to the shaft 28 for rotation therewith. The engine housing surrounds the working parts of the engine, provides a leakproof chamber for the air-fuel mixture and dissipates the heat generated in the cylinders.

Figure 8:
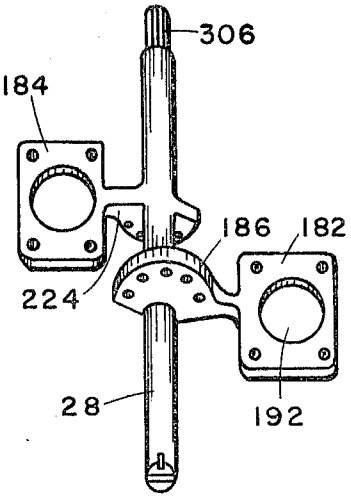
FIG. 8 is a perspective view of the engine axle or shaft to which the engine housing and associated parts are fixed for rotation.
Figure 4:
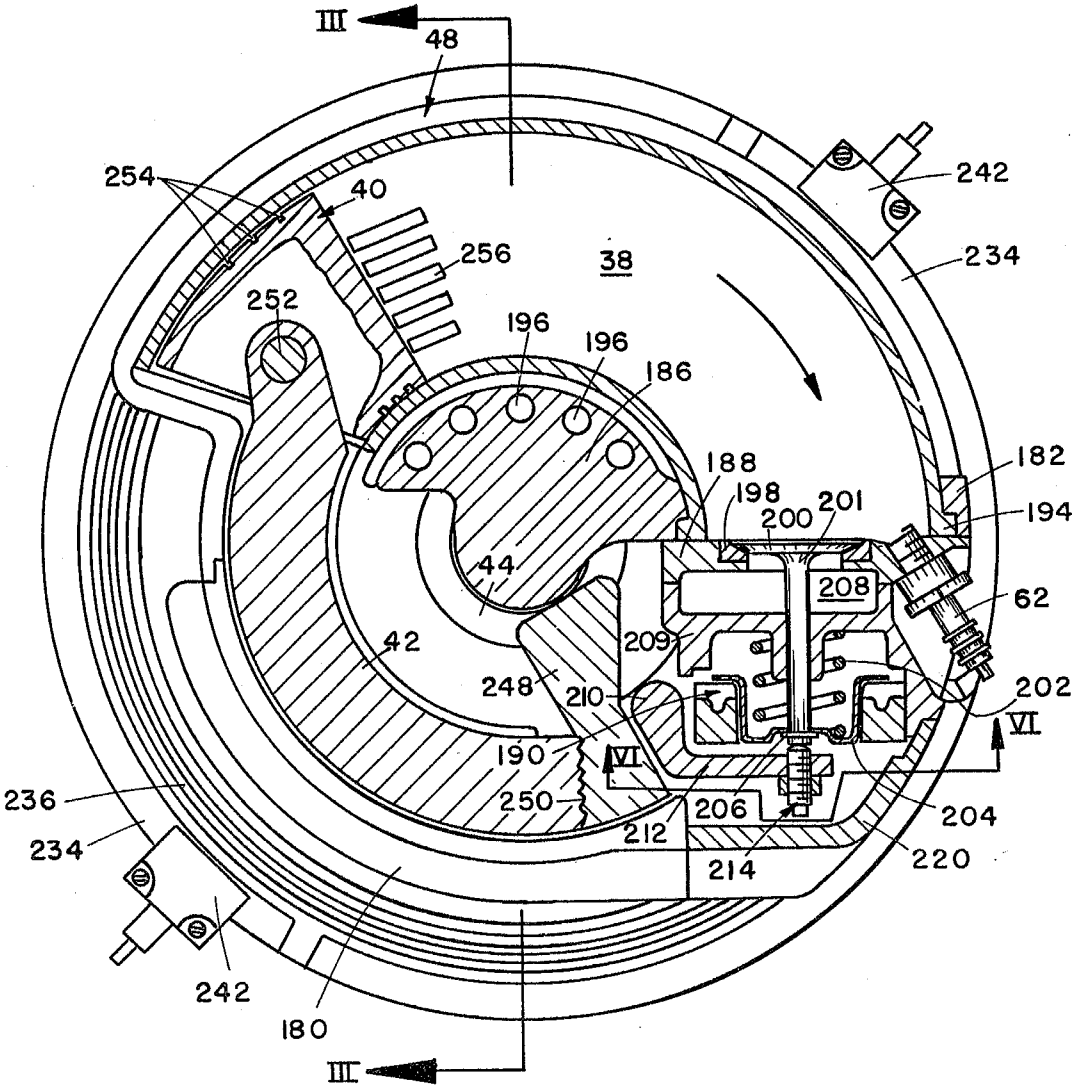
FIG. 4 is a cross-sectional view taken generally along the plane IV—IV of FIG. 3.

Referring briefly to FIG. 8, engine shaft 28 is an elongated shaft having a pair of oppositely directed outwardly extending paddles which form housing retainer elements 182 and 184. The engine housing 48 is fixed to the housing retainer elements. Housing retainer 182 extends outwardly from a flange 186 and is adapted to hold housing portions 179 and 180, cylinder 38, cylinder head 188 and exhaust valve assembly 190. Housing retainer 182 has an opening 192 formed therethrough which forms a lip or channel adapted to mate with a corresponding outwardly extending end portion or flange 194 on cylinder 38. As illustrated in FIGS. 3 and 4, flange 186 formed on shaft 28 has a series of bolt holes or openings therein to receive bolts 196 by which the housing parts 179 and 180 are secured together to enclose the cylinder and to fix the housing assembly to shaft 28.

Cylinder head 188 is secured to housing retainer 182 to form the top or closed end of the combustion chamber. Spark plug 62 is threaded in cylinder head 188 and extends into the combustion chamber in a conventional manner. Cylinder head 188 has a valve seat 198 formed therein against which the head of an exhaust valve 200 is seated.

Figure 6:
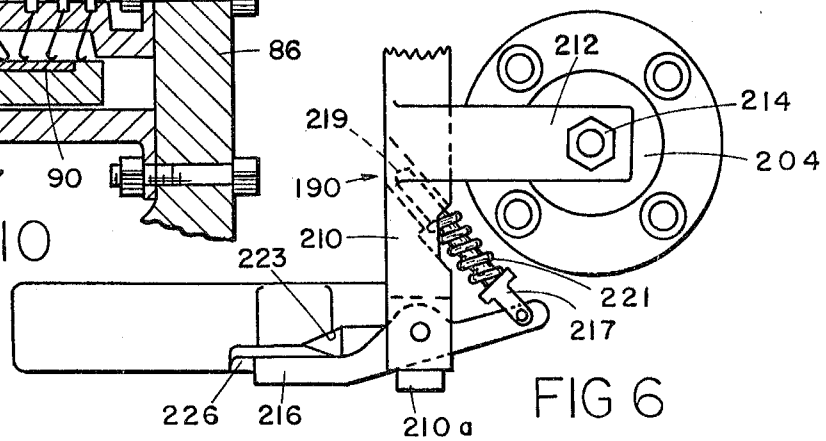
FIG. 6 is an enlarged cross-sectional view illustrating the exhaust valve actuating mechanisms.

Exhaust valve assembly 190 includes exhaust valve 200 having a stem 201 which passes through the cylinder head 188 and manifold header 209 where it is held in position by a conventional valve spring 202, a holding cup 204 and a valve spring keeper 206. The keeper fits in a groove around the valve stem 201 and retains the valve spring and holding cup on the valve stem. The exhaust chamber or port 208 is located directly below valve 200 and valve seat 198 in an exhaust manifold header 209. A tappet 210 (see also FIG. 6) is pivotally mounted and has an outwardly extending arm portion 212 into which an adjusting screw and lock assembly 214 is positioned to abut the lower end of valve stem 201 to adjust the valve lash. Tappet 210 is held in place by end portions 210*a* which extend into suitable openings 210*b* (FIGS. 5*g*, 5*h*, 5*i* and 5*j*) in the cylinder housing. The tappet transmits the movement of cam follower 216 to open and close exhaust valve 200. Cam follower 216*a* engages a cam surface 218 formed on the torque sleeve 44 (see FIG. 3). A cam follower push rod 217 (FIG. 6) is fixed at one end on the cam follower 216 while the opposite end extends into and is guided by an opening 219 in tappet 210. A spring 221 encircles push rod 217 and biases cam follower 216 against cam surface 226. As the torque sleeve 44 rotates with movement of piston 40, movement of the cam follower 216 on cam surface 226 causes valve 200 to open and close at the prescribed time. The exhaust valve assembly 190 is closed by a removable cover member 220. In operation, the exhaust valve assembly operates to open and close the valve in a manner conventional to two stroke cycle engines.

The rear or number two cylinder housing 222 includes two portions, a left side housing 222*a* and a right side portion 222*b* (FIG. 5*i* and 5*j*) which are fixed together and to shaft 28 and retainer 184 and 224 in the same manner as that previously described in connection with the front or number one cylinder assembly. Like components including the cylinder head, exhaust valve assembly, exhaust manifold, pistons and cylinders are accordingly designated with like reference numerals.

The cylinder housings 48 and 222 are fixed together and positioned such that the head portion of cylinder 222 is fixed to retainer 184 on shaft 28 and is positioned 180° from the head or top of cylinder 48. As shown in FIG. 3, rear cylinder 222 is similarly fixed to shaft 28 by bolts 196 received in bolt hole openings provided in a flange 224 fixed on shaft 28. Flange 224 corresponds to flange 186.

Cam follower 216*a* of the exhaust valve assembly 190 is adapted to engage a cam surface 218 formed on right hand side 228 of torque sleeve 44. The cam follower 216*a* forces tappet 210 to open and close exhaust valve 200. Cam surface 218 formed on the torque sleeve is part of a disc welded or otherwise fixed to the torque sleeve and serves additionally to strengthen and reinforce the torque arm.

Cam follower 216 is held by tappet 210 and rotates with the engine housing to follow the contour of the cam. As the piston moves toward the end of the power stroke, the follower moves up an incline on the cam surface to open the exhaust valve. Simultaneously, while the cam follower is operating to open the valve, the follower is moved sideways by a second surface 223 formed on the cam surface (see FIG. 6) nearly perpendicular to the shaft axis. The second surface 223 pushes the cam follower off the first surface, the follower slides down a ramp and the exhaust valve closes.

The rear cylinder housing 222 includes a semicircular outwardly extending flange portion 232 on its left side portion 222*a* and the front cylinder housing 48 includes a similar raised outwardly extending flange 230 on its right side portion 180. When the cylinder housings 48 and 222 are fixed together, the outwardly extending flanges 230 and 232 form a continuous annular ring around the cylinder housings 48 and 222 to provide a mounting surface for a high voltage conducting ring 234. Conducting ring 234 connects a fixed high voltage power supply, i.e., an ignition coil 370 and 372 (FIG. 9) to spark plugs 62. Conducting ring 234 is electrically isolated from the cylinder housings 48 and 222 by a nonconductive insulating ring 236. Conducting ring 234 is electrically connected to each spark plug 62 by a wire 238. Current from the high voltage source and a timing mechanism 240 (FIG. 3) is conducted to ring 234 through a brush block assembly 242 which include a pair of brushes 244 and 246 engaging opposite sides of conducting ring 234.

As best illustrated in FIGS. 4, 5*f*, 5*h* and 5*j*, torque sleeve 44 includes an outwardly extending arm member or torque arm portion 248. Torque arm 248 has a serrated or ribbed surface 250 mating with a corresponding surface on the lower end of the piston connecting rod 42. The connecting rods are generally T-shaped in cross section for strength and rigidity. The serrated end of the connecting rod is bolted to torque arm 248 while its opposite end is connected to the piston by a wrist pin 252. Piston 40 is slightly curved along its length to correspond to the curvature of the cylinder 38 in which it is movable. A seal between the cylinder walls and piston is provided in the conventional manner by piston rings 254.

Each cylinder is equipped with air-fuel mixture inlet slots 256 machined through the cylinder wall. Slots 256 admit the air-fuel mixture when the slots are exposed by the piston at the end of its power stroke. The cylinder housings 48 and 222 have a corresponding relief 258 machined in their inner facing surfaces for passage of the fuel air mixture through the slots and into the combustion chambers from within the area defined by the assembled cylinder housings.

The support rib 227 of right hand side 228 of torque sleeve 44 receives a fuel mixture holding disc 260 and a seal member 262 including springs 264 similar to the previously described holding disc 154, seal ring 152 and bias springs 160. The discs and seals 154, 152 and 260, 262 prevent loss of the fuel air mixture from within the engine cylinder housing.

Figure 7A:
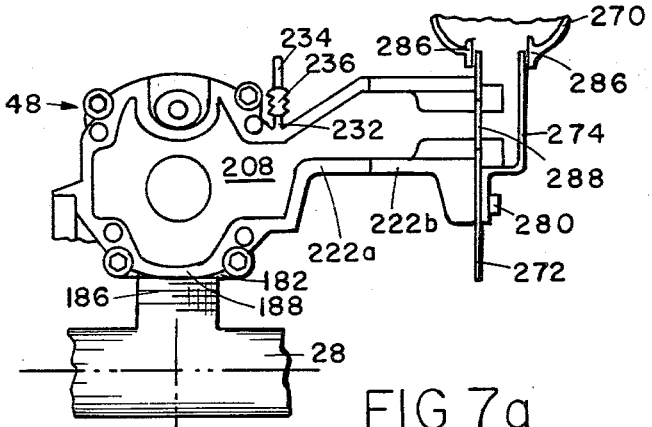
FIGS. 7*a* and 7*b* are fragmentary views illustrating the exhaust manifold system incorporated in the present invention.
Figure 7B:
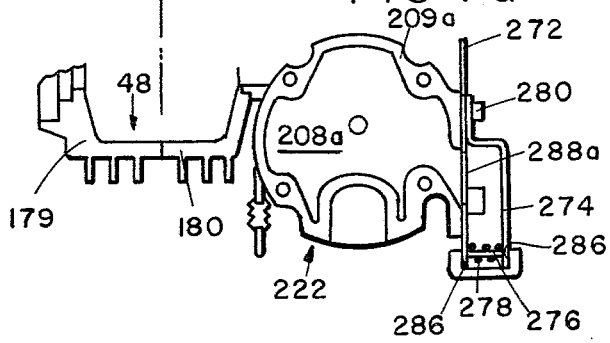

The exhaust manifold (see FIGS. 5*j*, 5*k* and 7) includes a fixed annular portion 266 and a rotatable portion 268. The fixed exhaust manifold portion 266 is in the form of a ring, remains stationary, and is held in place with support members attached to the engine mounting structure. The engine exhaust pipe 270 is fixed to the ring 266 and may be connected to conventional exhaust muffling devices. The rotatable portion 268 of the exhaust manifold includes a pair of discs 272 and 274. Disc 274 is provided with a series of axially extending pin members 276 which receive springs 278 to abut against the the inner facing surface of disc 272. The raised central hub portion 282 of disc 274 has openings therethrough in alignment with corresponding openings 284 in disc 272 to receive screws 280 by which the two sections 272 and 274 are fixed to the cylinder housing. Springs 278 bias the outer edges of discs 272 and 274 apart and into engagement with corresponding sidewalls 286 formed on the fixed portion 266. Openings 288 and 288*a* through disc 272 communicate with exhaust manifold header 209 and 209*a* from the exhaust ports 208 and 208*a*. As shown in FIGS. 7*a* and 7*b*, it will be noted that the exhaust passageways from cylinder housing 48 extend also through a passageway 208 formed in cylinder housing 222 behind the piston and cylinder where it is connected to communicate with opening 288 in disc 272. The exhaust chamber 208*a* passes directly from cylinder housing 222 and is in communication with opening 288*a* in disc 272.

The shock absorber assembly generally designated by the numeral 290 (FIGS. 3, 5*k* and 5*l*) comprises two platelike shock members 292 and 294. Four resilient pad members 296 and 297 provide the cushioning mechanism for the shock absorbers. Two resilient pads are mounted on each plate member. The left side shock plate 292 has a splined central hub portion 298 by which it is mounted on the right hand part 228 of torque sleeve 44*a*. Shock plate 292 carries a pair of oppositely directed pad members 296 (one is shown in phantom in FIG. 5*k*). Plate 292 is fixed to torque sleeve 44 by screws 300 passing through openings in the central hub portion and into threaded openings 301 in a spline holder 302.

The right hand shock plate 294 similarly carries a pair of resilient pad members 297 oppositely directed and adapted to cushion and engage resilient pad members 296 on plate 292. Plate 294 also has a splined central portion 304 adapted to match with spline 306 formed near the end of shaft 28. Plate 294 is secured to shaft 28 by a spline holder 308 and screws 310 received in threaded openings 311 in the spline holder. Shock plate 294 has a thickness greater than that of shock plate 292. The greater mass rotating with the engine and shaft 28 provides also the function of a flywheel to dampen vibrations caused by the rotating parts and to provide sufficient inertia to continue rotation of the engine after each power stroke. At the end of a power stroke, the resilient pad members 296 and 297 give a bounce effect to the stationary plate member after the full impact force is absorbed and the pistons start another compression stroke. The bounce effect contributes to the force needed to return the pistons during the compression stroke.

Shock plate members 292 and 294 each also carry low voltage conducting rings 312 and 313, respectively, separated from the metallic portion of the shock plates by an insulator 314. The low voltage electrical conducting rings provide a continuous method of electrical contact for the reciprocating parts and the rotating parts to signal the timer 406 to fire the spark plugs when the piston is in the cylinder at the proper position for a power stroke. The conducting ring around the left side shock plate 292 holds a timing shoe 316. Timing shoe 316 contacts the conducting ring 313 sliding as the engine runs. The conducting ring 313 around the right hand shock plate 294 holds a piston out indicator switch 318 to indicate the position of the piston.

Indicator switch 318 is mounted on conducting ring 313. In operation, switch 318 signals the engine starting system that the piston is retracted and the starting brake can be released. Grounding pad 380 (FIGS. 3 and 5*k*) is a small wedge-shaped pad and extends from the surface of the left shock plate 292. The grounding pad contacts indicator switch 318 that slides up its inclined surface as the piston is retracted. When the piston is retracted, switch 318 shorts out the electrical current supplied through pad 380 and conducting clamp 320 to ground. The timing shoe 316 passes the electrical current from conducting ring 312 to conducting ring 313. While the engine is operating, centrifugal force prevents the switch from contacting the left shock plate 292.

Timing shoe 316 is held by the conducting ring 312 around disc 292 and slides on the opposite conducting ring 313 or at certain times on an insulated portion 319 of the conducting ring surface. While the timing shoe is in contact with the conducting ring 313, the piston is not in a proper position to start a power stroke. When the piston is in its proper position, the timing shoe slides over the insulated portion 319 breaking the current flow providing a signal to fire the spark plug. Low voltage electrical conducting clamps 320 and 321 include spring loaded, conductive brushes 323 and 325 which engage the conducting rings 312 and 313 to pick up electrical signals from the timing shoe 316 as will be described hereinafter in connection with the description of the electrical system of the invention.

As mentioned previously, tapered thrust bearing 26 is mounted within a flange 24 formed in the rear support plate 14. The thrust bearing is retained in place by a wave washer 322 and a support sleeve 324. Support sleeve 324 has a splined central portion to fit over the shaft 28 and provides a smooth circular surface for O-ring seals 334 and a supporting surface for the inner race of thrust bearing 26.

A side plate 326 is positioned in spaced relationship with respect to rear support plate 14 by an annular spacer 332. Screws 330 passing through the rear support plate 14 and spacer 332 are received in threaded openings 328 formed in side plate 326. Side plate 326 forms one side of the tapered thrust bearing container. The container protects the bearing from dirt and other contamination and also serves as a reservoir for grease for lubrication of the bearing. A tapered pin 336 secures support sleeve 324 to shaft 28.

Referring back to FIGS. 3, 5*a*, 5*b* and 5*c*, it will be recalled that spring disc 70 which retains the outer end of springs 58 and 60 is movable in and out along the axis of axle 28 to vary the spring tension. Spring tension adjuster 80 operated by electromagnet assembly 84 locks against the edge of spring disc 70 and prevents the spring disc from rotating when the engine is started.

Hub 76 of the spring disc is operatively connected to transmit power from the spring holder disc 70 to hub 78 connected to disc brake 52. A worm wheel 350 having a threaded central portion is threaded on the outer diameter of hub 351 of an electromagnet and tension adjuster holder 346. The inner diameter of hub 351 is slidably received on hub 76 of spring disc 70. A bearing 344 is positioned between a flange 358 formed around hub 351 on holder 346 and the back surface of the spring holder disc 70. A seal ring 342 retained by a holder 340 prevents the lubricant from leaking from bearing 344. Worm wheel 350 has also a radially inwardly facing annular flange 360 formed on one side which abuts against a thrust bearing 352 positioned between worm wheel 350 and hub 78. Bearing 352 contacts only hub 78 and worm wheel 350. A holder ring 348 is bolted to the brake support 108 to hold the worm wheel in position yet allows it to rotate with respect to brake support 108.

A worm gear 356 drives worm wheel 350 by means of an electric motor 354. Motor 354 secured to brake support 108 is selectively operable in either direction to rotate worm gear 356 and to rotate worm wheel 350. The worm wheel 350, when rotated by motor 354, causes holder 346 and the associated spring tension adjustment mechanisms to move along the axis of the shaft 28 forcing the spring disc and the springs associated therewith to move in or out along the shaft causing the spring disc 70 to rotate relative to hub 78 to thus vary the tension on springs 58 and 60.

ELECTRICAL CIRCUIT AND ENGINE OPERATION

Figure 9:
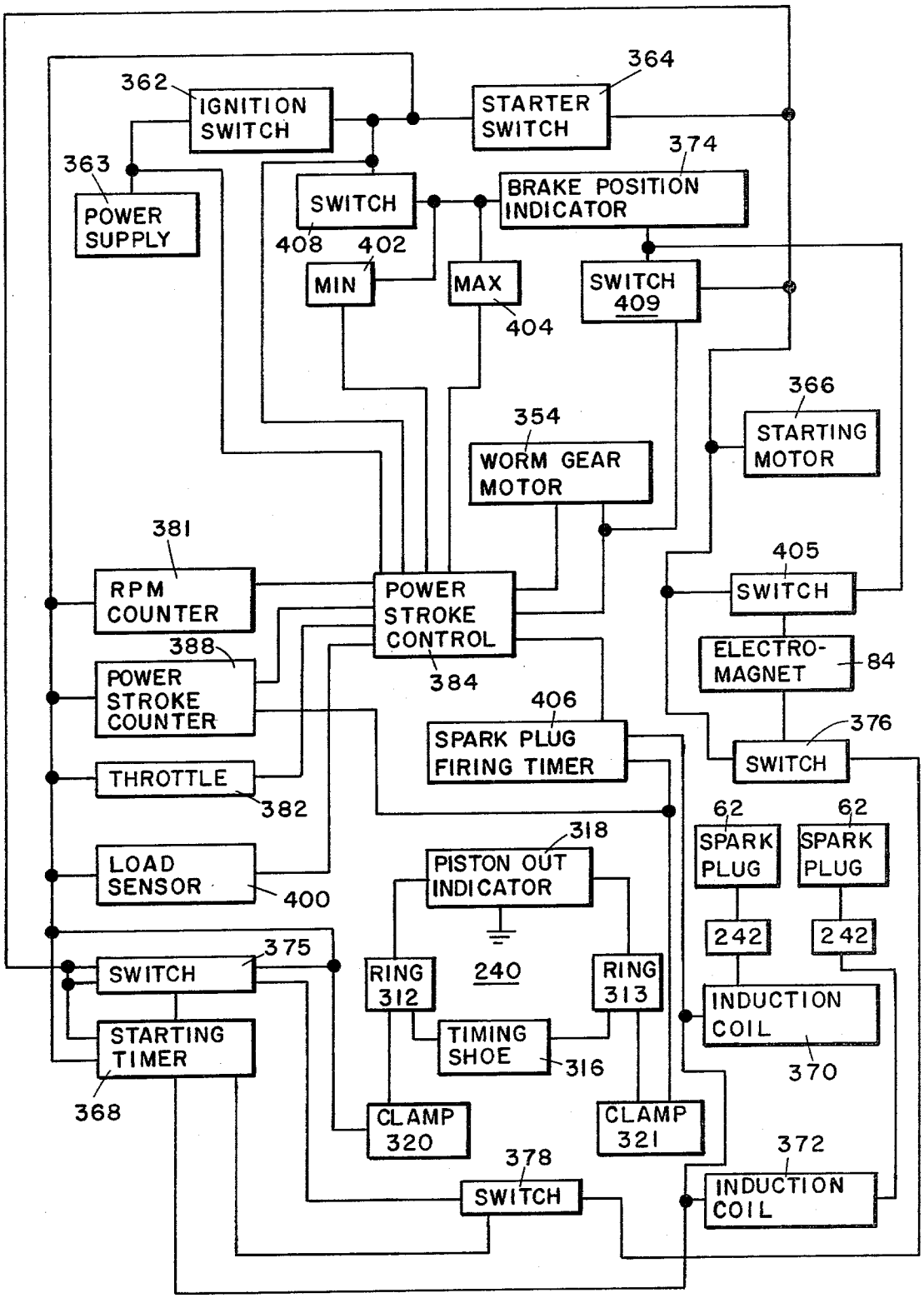
FIG. 9 is a circuit diagram illustrating the control circuits for the engine of the present invention.

Having disclosed the mechanical components of the engine, reference may now be had to FIG. 9 wherein the electrical circuits for the engine are disclosed in schematic form.

The ignition switch 362 supplies power from the power source as a battery 363 to all of the operating systems including a power supply switch 408 and the starter motor 366 through starting switch 364. Current is also supplied through power supply switch 408 to operate the various sensing devices associated with the brake position indicator switch 374 and the maximum and minimum spring tension indicator switches 402 and 404. When ignition switch 362 is closed, the engine can be started by operation of starter switch 364. When starter switch 364 is closed, electromagnet 84 is energized moving spring tension adjuster 80 (FIG. 3) into engagement with the edge of spring disc 70 to hold the spring disc from rotation. Starting motor 366 then rotates the engine and at the same time worm gear motor 354 rotates the worm gear and associated worm wheel 350. The starting timer 368 is energized and supplies current to the induction coils 370 and 372. As the engine is rotated by the starting motor, bias springs 58 and 60 on spring disc 70 are tightened and the pistons 40 are pulled outwardly with respect to the cylinder head 188. As the springs 58 and 60 are tightened, spring disc 70 moves along the axis of shaft 28 with rotation of the worm gear 356 and worm wheel 350. Spring disc 70 and the electromagnet and tension adjustment holder 346 associated therewith move along the axis of the shaft. When the coil springs are wound sufficiently to start the engine, the brake position indicator 374 provides a signal to relay switches 405 and 409 to turn the worm gear motor 354 off and releases electromagnet 84 thus releasing the spring tension adjuster 80. When the spring tension adjuster is released, spring disc 70 will move inwardly along the axis of shaft 28 until it is stopped by the hub 358 on holder 346 compressing bearings 344 and 352 while simultaneously the torque arm 44 is rotated forcing the pistons into the cylinder on a compression stroke.

Figure 5K:
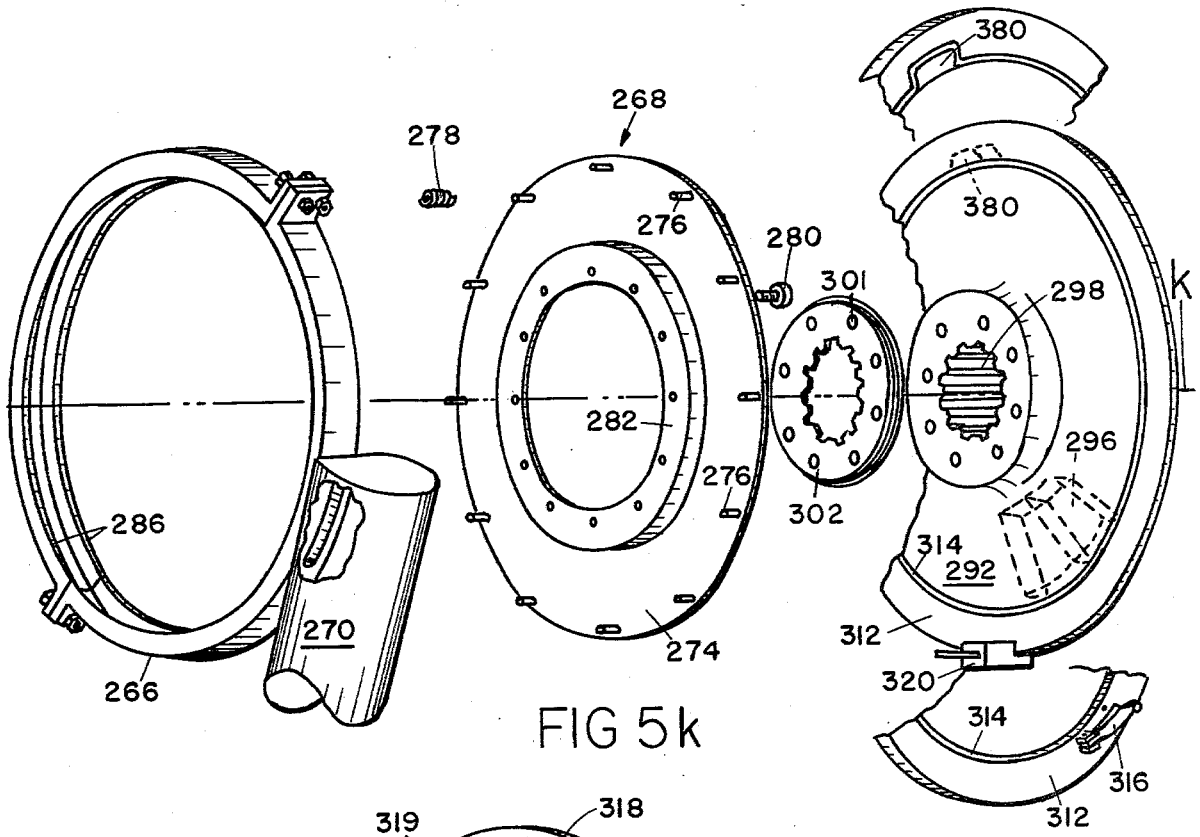
Figure 5L:
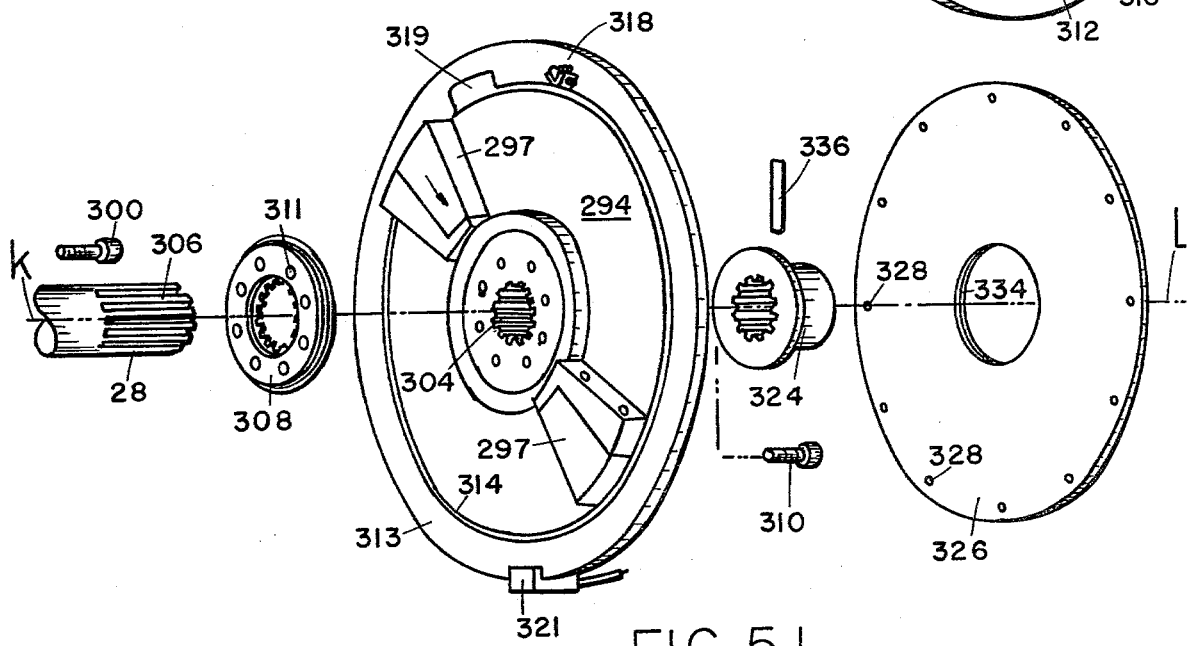
Figure 5M:
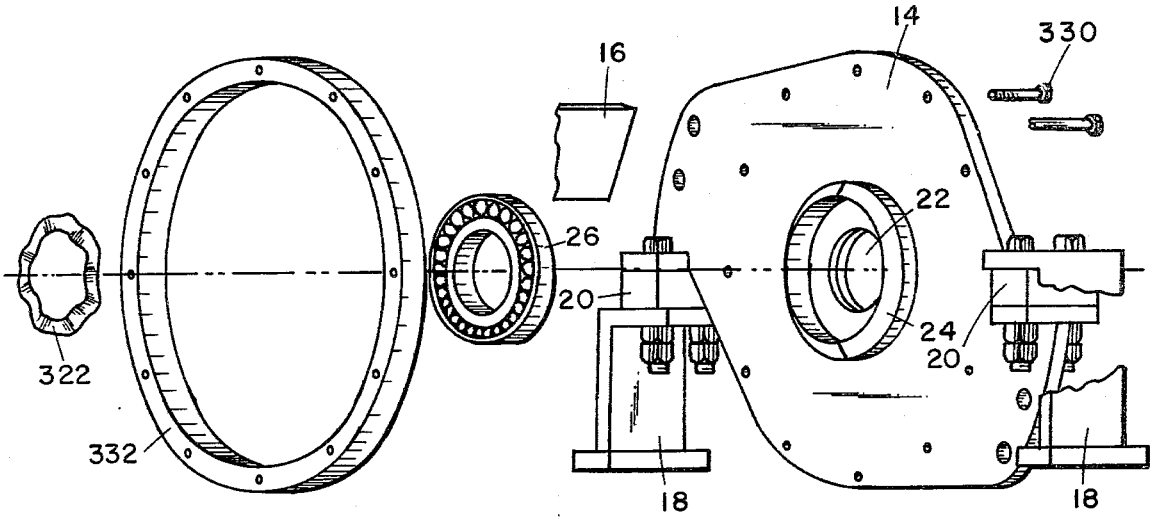

Before the tension adjuster 80 releases, the bias springs 58 and 60 must, of course, be wound sufficiently and the pistons must be located near the bottom of the cylinders. This position of the pistons is detected by piston out indicator switch 318. When switch 318 closes, relay switch 375 detects the current flow and signals the starting timer 368 that the piston is out. Simultaneously, a signal is applied to relay switch 376 causing it to open and disconnect the current applied to the electromagnet 84 releasing spring disc 70 if the bias springs 58 and 60 are tensioned. Once switch 375 signals timer 368 that the piston is in position, the timer signals relay 378 to keep the line to the electromagnet 84 or relay 376 open. The starting timer 368 also supplies current to coils 370 and 372 when the starting switch is closed until the piston has started into the cylinder because the piston out indicator switch 318 grounds the timing circuit. The grounding of the timing circuit in effect cuts current flow to coils 370 and 372 causing the spark plugs 62 to fire. The piston out indicator switch 318 has sufficient resistance to prevent damage to the circuit when it touches the grounding pad 380 (FIGS. 3 and 5*k*).

As the spring disc 70 is released, piston out switch 318 opens and switch 375 conducts only if the start switch 364 is closed. When piston out indicator switch 318 opens, a signal is provided by switch 375 to the starting timer 368 to shut off current to the coils 370 and 372 after a short period of time allowing the timing mechanism 240 to function. If starting timer 368 does not receive pulses from coils 370 and 372 indicating that the spark plugs are firing, the starting timer 368 signals relay 378 which in turn signals switch 376 to actuate electromagnet 84 to hold spring disc 70. The starting sequence repeats to again operate and withdraws the pistons for another compression stroke. For starting timer 368 to repeat the starting sequence, the starting switch 364 must be closed.

Once the engine is started, the speed and power are regulated by a number of sensing and control devices. The operator of the engine determines engine speed or revolutions per minute with the throttle controller 382 which in turn is connected to carburetor 146. When the throttle controller is set, carburetor 146 automatically mixes the proper ratio of fuel and air. Since the piston is returned into the cylinder by springs 58 and 60, the number of engine revolutions per piston power stroke can vary depending upon the load and the revolutions per minute of the engine. If, for example, the engine is idling at low revolutions per minute and with no engine load, the engine could revolve, for example, three times for every power stroke. As the load on the engine is increased, the revolutions per power stroke ratio can be decreased to for example, one revolution per power stroke.

The engine sensing and control devices function together to operate the engine at maximum efficiency under any given load. This is primarily by the power stroke controller 384. Power stroke controller 384 provides current to the electric motor 354 which operates the worm wheel to vary the tension on the springs 58 and 60. The controller 384 operates motor 354 in either forward or reverse direction to increase or decrease the spring tension. To regulate the spring tension, the controller receives signals that are processed into engine requirements from various sensing devices including the revolutions counter 381, a power stroke counter 388, the throttle controller 382 and a load sensor 400. The controller 384 also receives signals from an electrical contact 402 indicating that springs 58 and 60 are at minimum tension and by a similar electrical contact 404 indicating that the springs are at maximum tension. A signal from either switch 402 or 404 stops the operation of the worm gear motor 354 to keep the coil springs within their working limits. Any detected change in the load or throttle setting will immediately cause the controller to change the spring tension a small or large amount depending upon the degree of change detected by the sensors.

It will be noted that the pistons are not mechanically linked to the rotating shaft 28 or its associated members in a manner that would control the number of engine revolutions per power stroke. This accordingly, allows the pistons to begin a power stroke at virtually any position relative to the cylinder or spark plug. The compression ratio of the fuel air mixture is controlled by the distance that the piston moves into the cylinders toward the cylinder head during the compression stroke and before the spark plug 62 fires. Timing mechanism 240 signals the spark plugs to fire when it breaks contact with the electrical conducting ring 313 by sliding over the nonconducting area 319 (FIG. 51) of insulating ring 314. This mechanical relationship provides the lowest compression ratio although the compression ratio can be increased by delaying the spark plug firing. This delay is developed by the spark plug firing timer 406. The longer the time lag, the higher the compression ratio. The length of the time lag or compression ratio required is determined and controlled by the power stroke controller 384. The controller varies the compression ratio so that the engine always operates at maximum efficiency. When idling, the compression ratio may be low as, for example, 8:1. Under normal operation under load, the compression ratio may be considerably higher as, for example, 10:1 or 12:1. When the ignition switch is opened, the engine, of course, is shut off, then the power stroke controller 384 causes worm gear motor 354 to operate automatically reducing coil spring tension and the fuel supply is cut off.

The advantages of the present engine will be appreciated by those skilled in the art. The engine has, for example, a comparatively higher thermal efficiency. Because the engine is air cooled, the engine can operate at a high temperature (i.e., the materials around the combustion chamber can be hotter than if water cooled). The higher the operating temperature of the engine, the greater its efficiency. The piston moves with very little friction allowing the surfaces of the combustion chamber and piston to operate at very high temperatures. The combustion chamber is of optimum design so that the air-fuel mixture is more completely burned. The higher the temperature of combustion, the more likely nitrogen oxides (a pollutant) will be formed. The combustion process is a function of time, pressure (volume), and temperature. This engine can operate at very high temperatures because the combustion chamber volume increases so rapidly (as compared with the regular piston engine) that the peak temperatures and pressures necessary for nitrogen oxides to form are rarely reached. The rapidly increasing volume of the combustion chamber also allows the engine to operate at a very high compression ratio or as determined by the power stroke control to maximize the engine's efficiency.

The provision of a variable compression ratio as opposed to an engine with a fixed compression ratio increases engine efficiency by allowing the engine to run at the optimum compression ratio taking into consideration engine load, speed and other operating conditions.

Pollution is minimized as the combustion chamber is designed to minimize the amount of cool surface area the burning gas comes in contact with thus insuring complete combustion and a very low level of unburned hydro-carbons being released to the atmosphere. The amount of oil (mixed with the fuel) required to lubricate the engine is very small because of the almost frictionless design of the working parts. When the air-fuel mixture is ignited, the oil burns along with the fuel. When the exhaust valve opens, the products of complete combustion will leave the combustion chamber. Any unburned or incompletely burned products will remain near the piston and along the cylinder walls. The conventional four stroke piston engine scrapes the hydrocarbons off the cool cylinder walls and ejects hydrocarbon material from the space between the piston and cylinder into the exhaust (after the power stroke) on the exhaust stroke.

The fresh air-fuel mixture entering the combustion chamber will not escape through the exhaust port because the exhaust valve opens and closes before the incoming gas reaches the cylinder head.

The engine design delivers torque to a rotating shaft in the most efficient manner possible. The force of the expanding gas is applied perpendicular to an arm or piston extending from the axle forcing it to turn.

The engine develops a tremendous amount of torque and when loaded down has a great lugging power. When the burning gas forces the piston to the end of the power stroke, the coil spring will return the piston into the cylinder automatically.

Compared to other internal combustion engines, the radial torque engine has higher thermal efficiency, lower level of pollution, higher horsepower to weight ratio, higher torque and less friction.

To summarize the invention in view of the above disclosure, those skilled in the art will appreciate that the radial torque engine of the invention has one or more pistons that reciprocate within a cylinder at a constant radius in a plane perpendicular to the central engine axis. The cylinder and cylinder head are held in a fixed position with respect to the central axis by an engine housing and a cylinder support. The piston is fixed to a piston rod which, in turn, is supported by a torque arm rotatably mounted on the engine shaft. The torque arm including a torque sleeve encircles the engine shaft and forms a continuous concentric ring about the shaft in and outside of the engine housing except, of course, where the cylinder support is located on the shaft. The torque sleeve is fixed to a disc brake mechanism that limits the motion of the pistons when combustion occurs. Upon ignition and combustion, the brake holds the pistons by holding the torque sleeve stationary while the piston and cylinder heads are forced apart, only the cylinder and the engine housing in which it is contained and the shaft are in rotary motion.

The piston and the cylinder head are at maximum distance apart when the shock absorbers strike each other. At this time, the brake is released allowing the movable part of the brake to rotate at the same angular velocity as the engine housing and the shaft. At this time, the pistons, cylinder, engine shaft, the housing, torque sleeve and the like are rotating at the same angular velocity and in the same direction.

After ignition and the power stroke, the piston is returned to the cylinder toward the cylinder head for another power stroke via the bias springs attached to the engine housing and torque sleeve. When the fuel is ignited, the spring acts to hold the piston and the cylinder head together but the force of combustion is greater than the opposing spring force. This spring force, however, is sufficient to compress the fuel mixture to the desired pressure. The air-fuel mixture continues to be compressed after ignition because the force on the pistons of the burning mixture has not exceeded the momentum of the moving components. The compression ratio is at maximum when the piston stops moving into the cylinder at which time the power stroke begins. Before the spring can return the piston at the end of the power stroke, the exhaust port opens to reduce the pressure. The exhaust valves open near the end of the power stroke permitting the escape of exhaust gases and reducing the pressure in the cylinder. Simultaneously, the intake ports are uncovered by the piston and the compressed fuel-air charge from within the engine housing flows into the cylinder expelling the exhaust gases.

The engine housing does not stop when the shock absorbers strike each other because the force of combustion combined with a mass larger than the piston assembly gives the engine housing enough angular momentum to force or maintain the mass in rotary motion. The number of revolutions or time required for the springs to return the piston into the cylinder depends, of course, upon the load, angular velocity of the shaft and the bias spring tension.

Although the invention has been described with reference to a preferred construction, it will be obvious to those skilled in the art that other mechanical arrangements can be employed as, for example, a change in the configuration of the pistons, the cylinders or the various mechanisms associated with the rotary engine. Other variations and modifications will be suggested to those skilled in the art without departing from the scope of the invention which is defined by the following claims.

The embodiments of the invention in which an exclusive property or privilege is claimed are defined as follows:

1. In a rotary internal combustion engine including a housing having a plurality of combustion chambers formed therein; means including a supporting framework mounting said housing for rotation about an axis defined by a shaft member, said shaft member supporting said combustion chambers for rotation therewith, said chambers being formed in said housing circumferentially with respect to said axis; a plurality of pistons cooperably operable in said combustion chambers to cause said housing to rotate; means for supporting said pistons for movement in said chambers with respect to said housing, said supporting means including a sleeve member journaled on said shaft member, said pistons having a connecting rod attached thereto and to said sleeve, said pistons and said housing being alternately movable toward and away from each other with rotation of said housing between at least compression and power strokes; means forming fuel inlet and exhaust passageways communicating with said combustion chambers; biasing means associated with said pistons for urging said pistons in the same direction of movement as said housing for moving said pistons into said chambers in a compression stroke; ignition means for igniting a fuel mixture in said combustion chambers at a predetermined position of said pistons during said compression stroke to thereby initiate a power stroke; means for holding said pistons with respect to said frame during said power stroke to prevent retrograde movement of said pistons thereby to urge said housing to rotate about said axis, said holding means including a brake, said brake including a first portion fixed relative to said supporting framework and a second portion fixed relative to said sleeve member, said sleeve being operatively connected to said holding means, and means for engaging said first portion and said second portion to hold said pistons from movement during said power stroke, said first portion of said brake member comprising a pair of brake shoes positioned on each side of said second portion, said second portion comprising a disc fixed relative to said sleeve for movement therewith, said disc having surfaces thereon adapted for frictional engagement with said brake shoes; and means for sensing the position of said pistons with respect to said chambers for releasing said holding means allowing said pistons to rotate with said housing.

2. The rotary engine as defined in claim 1 and further including said sensing means including control means responsive to said ignition means, said control means operatively connected to said holding means to engage said holding means upon ignition to thereby hold said piston from retrograde movement during a power stroke and to cause rotation of said housing.

3. The rotary engine as defined in claim 1 wherein said biasing means includes spring means having a first portion fixed relative to said housing for rotation therewith and a second portion operatively connected to said pistons.

4. The rotary engine as defined in claim 3 wherein said sensing means includes control means responsive to said ignition means, said control means operatively connected to said holding means to engage said holding means upon ignition to thereby hold said piston from retrograde movement during a power stroke and to cause rotation of said housing.

5. The rotary engine of claim 3 wherein said biasing means comprises coil spring means.

6. The rotary engine of claim 1 or 3 and further including adjustment means for said biasing means to control the force applied to said piston during a compression stroke whereby to vary the power strokes applied during each engine revolution.

* * * * *